US005398638A

United States Patent [19]

Bonk

[11] Patent Number: 5,398,638

[45] Date of Patent: Mar. 21, 1995

[54] FLYING FLAG POINT OF SALE DEVICE

[75] Inventor: Alfred T. Bonk, 6637 N. Loron Ave., Chicago, Ill. 60646

[73] Assignee: Alfred T. Bonk, Chicago, Ill.

[21] Appl. No.: 80,329

[22] Filed: Aug. 9, 1993

[51] Int. Cl.[6] ..... G09F 17/00

[52] U.S. Cl. ..... 116/173; 40/218

[58] Field of Search ..... 40/218, 412, 422, 435; 116/173, 174, 175

[56] References Cited

U.S. PATENT DOCUMENTS

| | | | |
|---|---|---|---|
| 1,102,270 | 7/1914 | Howard | 40/218 |
| 1,131,699 | 3/1915 | Hoecker et al. | 116/173 |
| 1,725,250 | 8/1929 | Burgess | 40/218 |
| 2,270,753 | 1/1942 | Fikes | 40/218 |
| 3,477,161 | 11/1969 | Drexler | 40/218 |
| 3,798,816 | 3/1974 | Flaherty | 40/218 |

FOREIGN PATENT DOCUMENTS

| | | | |
|---|---|---|---|
| 829663 | 7/1938 | France | 116/173 |
| 2647579 | 11/1990 | France | 116/173 |
| 102730 | 12/1937 | United Kingdom | 40/218 |

*Primary Examiner*—William A. Cuchlinski, Jr.
*Assistant Examiner*—Willie Morris Worth

[57] ABSTRACT

The object of this invention is to produce, by means of a blower device, consisting of a common blower motor installed into a housing base and a hollow tube mast with a special positioned air slot and flag stick also in a related special position to the air slot, that will effectively and consistently provide a means of delivering an air flow across the face of a cloth flag so it will fly in a full extended flutter motion within a still indoor environment so that a advertising message on the flag can be easily read.

1 Claim, 1 Drawing Sheet

FLYING FLAG POINT OF SALE DEVICE

BACKGROUND OF INVENTION

1. Field of Invention

The field of invention is generally flags that can be made to flutter in full wind motion within a indoors environment that is has no moving natural air flow.

2. Description of Prior Art

Many of the earlier examples, W. J. Burgess U.S. Pat. No. 1,725,250, R. S. Drexler U.S. Pat. No. 3,477,161 of such flag systems relate more directly to the source and delivery of air but little attention to an efficient means of producing a controlled air flow across the surface of a flag that will assure a consistent flag in full natural wind motion so that a advertising message can be visible to the viewer at all times. For example, the disadvantage of the Flaherty U.S. Pat. No. 3,798,816 system confines the edge of a flag to a ridged U shaped device that cannot allow the flag to act in a wind driven natural manner. If the U shaped clip were removed the air source outlets could not effectively unfurl and flutter the flag in an efficient and consistent manner.

Another example of a flag waving device is the Hoecker-Benze U.S. Pat. No. 1,131,699 which calls for a elongated air slot aligned generally parallel to the central axis of the tube and to a similarly vertically positioned flag. While there are a variety of devices that purport to execute the unfurling and flutter of a flag in a still indoor situation, some inherent deficiencies are apparent and to overcome such faults, my new system, that will be described later, can better assure the total effectiveness of the basic objective

SUMMARY OF THE INVENTION

My invention is an improved method of directing a stream of air across the flag surface in a controlled manner that additionally offers the user a easy method of attaching or removing the flag by means of flag tabs that act as a quick release snap-in system into which the flag, mounted on a flag; stick, can be inserted at the required angle to the air slot which is positioned at an acute angle to the longitudinal axis of the hollow tube mast. Because of the unique position of air slot opening and flag stick, a standard blower motor, mounted in the housing base, can be used to generate the intense air flow that is directed up the hollow shaft and exits through the angled air slot and moves across the face of the flag in such a manner as to hold the flag in a full flutter position making the message on the flag totally visible to a person in the immediate area.

DETAILED DESCRIPTION OF PREFERRED EMBODIMENTS

Figure 1:
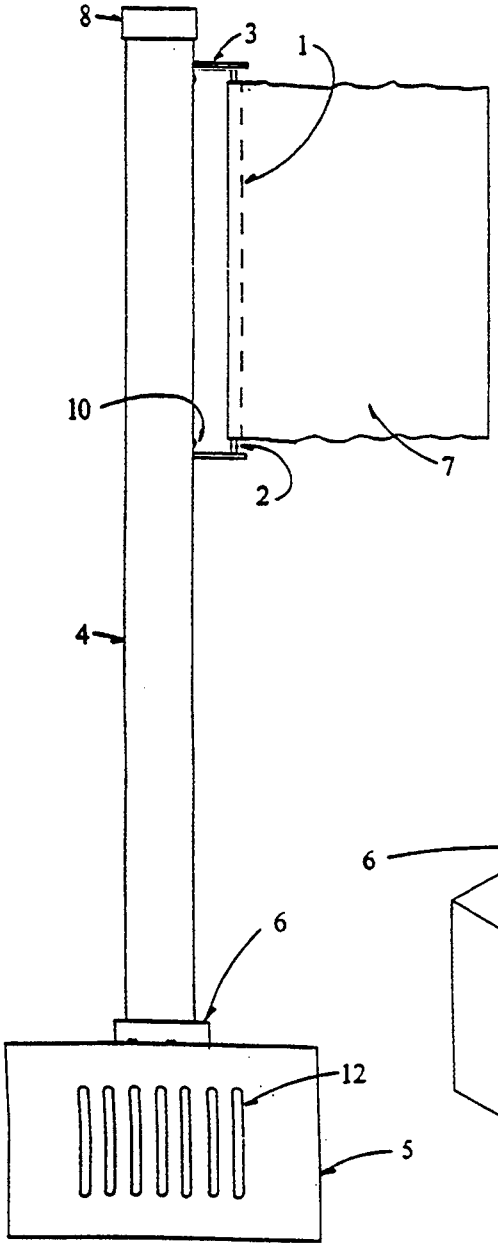
FIG. 1 is an elevation of the complete embodiment of the invention that encompasses the three basic elements that consists of housing base with blower motor mounted inside, hollow tube mast and flag.
Figure 3:
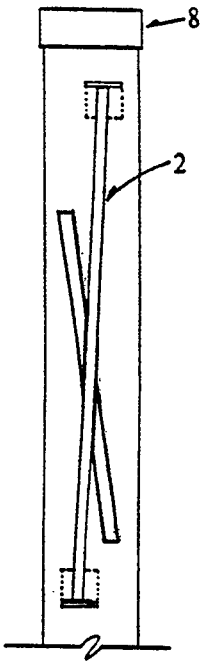
FIG. 3 is a sectional front view of the upper part of the hollow plastic tube that is capped on one end with an air slot opening on the side of the tube mast that has been positioned at a acute angle to the left and a flag stick that is positioned at a counter angle to the right.

This invention embodiment shown in FIG. 1, is an improved method of moving air at an intense rate in an indoor environment where natural air movement is non-existent, by means of a electric blower motor 13 and a hollow tube mast 4 that has a unique FIG. 3 position orientation of a slot opening 9 and flag stick 2 so that it controls the flow of air consistently across the surface of a flag and creates a flag in full flutter motion in any still indoor environment. Air escapes through FIG. 3 a narrow slot 9 of approximately ½" in width, that is at an acute angle to the left. The flag stick 2 is counter angled to the slot 9 in a position to the right. Hollow tube mast 4 is capped 8 on one end. Open end of hollow tube mast is inserted into the top FIG. 4 of housing base receiver 6 that can be a block, stem or pipe. The flag 7 itself is made of a typical flag material.

The flag has a sewn channel 1 into which a stick made of wood or plastic can be inserted. Other methods of attaching a flag to a stick such as, staples or glue can be used. The flag 7 and stick 2 is then inserted between the two protruding flag holder tabs 3, each of which have been securely attached to the mast by a rivet 10 located with specific designation to create the counter angle required to the slanted air slot opening 9.

Figure 2:
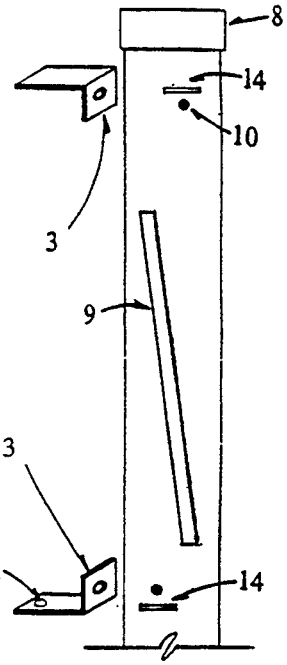
FIG. 2 is a sectional view showing the two bent plastic tab pieces, with a notched recess, that are used to accurately position the flag stick. Tabs are inserted through a small slot in the tube with the long end protruding outward and the short end riveted in place to the hollow tube.

FIG. 2 diagrams tab 3 positions and attachment by inserting short end through small slot 14 then riveting 10 to hollow tube mast. Tabs 3 are made of a firm plastic material that have been notched with a small recess 11 on the outward protruding end to accept and securely hold the ends of a flag stick. 2. Tabs can also be riveted securely to the outside of the tube in the same designated position. The flag stick 2 is approximately 3/16" longer than the measurement between the tabs which allows the flag stick to be held in place by the inward pressure exerted by the tabs 3. A flag can be easily changed by removing the flag 7 and stick 2 in use from the flag holder tabs 3 and inserting a new flag and stick in its place. This feature gives this invention complete flexibility to re-use the mechanical portion of the unit numerous times and make the advertising message current and applicable to the existing market conditions.

Figure 4:
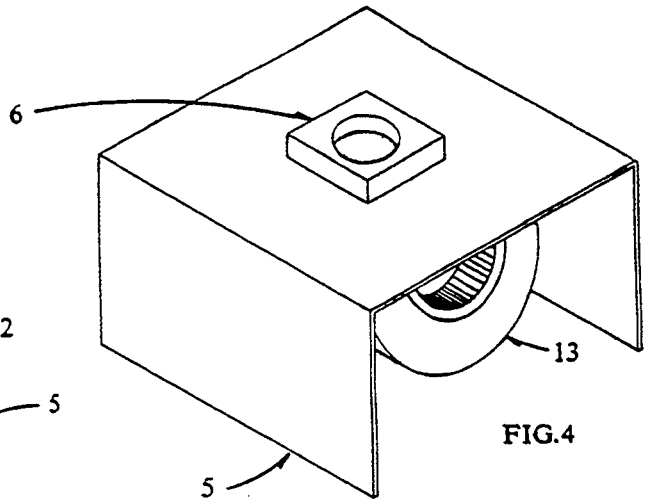
FIG. 4 is a view of the housing base and top opening for insertion of the hollow tube mast with blower motor mounted in an upward position.

Flag is pulsated by a means of directing the air flow up the hollow tube mast 4 by a blower FIG. 4 motor 13 mounted in an upward position in the housing base 5 that can be five sided as shown or produced in conical or other shapes. The air intake vents 12 on one side of the base allows the access of normal room air to and through the blower fins.

I claim:

1. A flying flag point of sale device comprising:

a hollow tube mast having one end closed by a cap and an open end; a narrow slot opening into the interior of the said hollow tube mast at an upper portion thereof; wherein said narrow slot is formed at an acute angle relative to the longitudinal axis of said hollow tube mast such that an upper end of the narrow slot lies on a first side of the longitudinal axis and a lower end of the narrow slot lies on a second side of the longitudinal axis; said hollow tube mast further including a pair of small slots; a first of said pair of small slots being spaced above the upper end of the narrow slot and the second side of the longitudinal axis: a second of said pair of small slots being spaced below the lower end of the narrow slot on the first side of said longitudinal axis;

a pair of L-shaped tabs; a first of said pair of L-shaped tabs is received in the said first narrow slot and affixed to said hollow tube mast; a second of said pair of L-shaped tabs is received in said second narrow slot and affixed to said hollow tube mast; wherein one leg of each L-shaped tab extending radially outward from said hollow tube mast and includes a recess facing said narrow slot;

a flag stick having two ends and a length slightly longer than a distance between the radially extending legs of the L-shaped tabs; whereby said flag stick ends are received in the tab recesses and the flag stick is removably secured to said hollow tube mast by pressure exerted by said tabs;

a flag having one end secured to said flag stick; a housing base receiver having an opening for receiving the open end of the hollow tube mast and a source of pressurized air within said housing base receiver communicating with said opening.

* * * * *